US005199697A

United States Patent [19]

Yamada et al.

[11] Patent Number: 5,199,697

[45] Date of Patent: Apr. 6, 1993

[54] AUTOMATIC TELLER MACHINE

[75] Inventors: Naohiro Yamada; Yutaka Nagahashi, both of Tokyo, Japan

[73] Assignee: Oki Electric Industry Co., Ltd., Tokyo, Japan

[21] Appl. No.: 734,782

[22] Filed: Jul. 23, 1991

[30] Foreign Application Priority Data

Aug. 16, 1990 [JP] Japan ..... 2-85875[U]
Dec. 19, 1990 [JP] Japan ..... 2-403579

[51] Int. Cl.[5] ..... G07F 19/00; B65H 3/06; B65H 3/52

[52] U.S. Cl. ..... 271/122; 271/126; 271/160; 902/12

[58] Field of Search ..... 235/379; 902/12; 209/534; 271/122, 126, 160

[56] References Cited

U.S. PATENT DOCUMENTS

| | | | |
|---|---|---|---|
| 3,880,320 | 4/1975 | Morello et al. | 221/9 |
| 4,744,468 | 5/1988 | Goi et al. | 235/379 |
| 4,820,909 | 4/1989 | Kawauchi et al. | 235/379 |
| 4,866,254 | 9/1989 | Okayama et al. | 235/379 |

FOREIGN PATENT DOCUMENTS

| | | | |
|---|---|---|---|
| 317537 | 5/1989 | European Pat. Off. | 209/534 |
| 60-251487 | 12/1985 | Japan . | |
| 235234 | 9/1988 | Japan | 271/126 |
| 71396 | 3/1990 | Japan | 235/379 |
| 2197301 | 5/1988 | United Kingdom | 271/122 |
| 2219120 | 11/1989 | United Kingdom . | |

*Primary Examiner*—John W. Shepperd
*Attorney, Agent, or Firm*—Spencer, Frank & Schneider

[57] ABSTRACT

An automatic teller machine according to this invention is equipped with a receiving/dispensing unit in a customer panel of a main body of the machine. The receiving/dispensing unit has a rotary body, which defines a gear, and an openable shutter. One ends of bill guides provided in the rotary body serve as a receiving opening through which bills can be received together. The rotary body is also provided with a unit for separating and feeding one by one the bills so received and also with a feed-in opening for feeding the thus-separated bills into the main body. A drive unit is provided to rotate the rotary body via the gear, whereby the bill guides are stopped at a receiving/dispensing position to perform a receiving/dispensing procedure.

4 Claims, 11 Drawing Sheets

AUTOMATIC TELLER MACHINE

BACKGROUND OF THE INVENTION

1. Field of the Invention

The present invention relates to an automatic teller machine (ATM) installed at a financial institution such as a bank to automatically provide the facilities of depositing or withdrawal when operated by a customer, and more specifically to the construction of a receiving/dispensing unit adapted to feed deposited banknotes (hereinafter called "bills"), which have been inserted through a customer panel by a customer, into the machine and also to return or dispense bills from the machine to a customer.

2. Description of the Related Art

A variety of automatic teller machines have heretofore been developed and actually employed to permit the automatic depositing or dispensing of bills when operated by a customer. They include, for example, those equipped with the bill receiving/dispensing unit disclosed in Japanese Patent Application Laid-Open (Kokai) No. SHO 60-251487.

The receiving/dispensing unit is provided behind a customer panel of a main body of the automatic teller machine, and includes a rotary body which rotates with bills inserted and deposited therein by a customer or with bills to be dispensed from the main body of the machine to a customer. A bill guide of the rotary body undergoes angular displacements to various receiving/dispensing procedure positions such as a customer position where a customer deposits or takes out bills, a feed-in position where bills are fed into the main body of the machine and a receiving position where bills are received after having been counted in the main body of the machine for dispensation to a customer. A conventional automatic teller machine equipped with the above receiving/dispensing unit will be described with reference to FIG. 10 of the accompanying drawings.

FIG. 10 is a simplified, schematic side view showing the internal construction of the conventional automatic teller machine, in which the money-receiving/dispensing unit designated generally at numeral 11 is provided with a shutter 12, a rotary body 13, a bill guide 14 and an inserter frame 15.

Arranged in a predetermined positional relationship along a periphery of the rotary body 13 are a bill separating and counting unit 16, a first storage portion 18, a second storage portion 19 and a temporary storage box 24.

The bill guide 14 of the receiving/dispensing unit 11, said bill guide 14 being constructed of bill guide members 14*a*,14*b*, rotates integrally with the rotary body 13 so that the bill guide 14 undergoes angular displacements to predetermined positions. These positions include a customer position a where the bill guide 14 is tilted at a predetermined angle (for example, about 30°) as indicated by solid lines so that a customer can deposit or take out bills, a feed-in position b where the bill guide 14 extends vertically corresponding to the bill separating and counting unit 16, a receiving position c where the bill guide 14 extends horizontally corresponding to the first storage portion 18 and the second storage portion 19, and a feed-in position d where the bill guide 14 is tilted at a predetermined angle in a direction opposite to the customer position d to correspond to the temporary storage box 24. The bill guide 14 undergoes angular displacements to these positions when the rotary body 13 rotates.

Although not illustrated in FIG. 10, the receiving/dispensing unit 11 has a roller for introducing bills into the bill guide 14, feeding out the bills from the bill guide 14 and holding the bills inside the bill guide 14.

With the construction described above, deposit and withdrawal transactions are conducted in the following manner.

Firstly, in the case of a deposit transaction, a customer presses an unillustrated deposit transaction button provided in a front customer panel of the machine, and inserts a passbook in an unillustrated passbook insertion slot or a card 23 into an insertion slot 22. The machine then conducts communication with a computer center and, when verified, the shutter 12 is opened.

At this time, the rotary body 13 of the receiving/dispensing unit 11 is temporarily held with the bill guide 14 kept standstill at the customer position a.

The customer then inserts bills together through a deposit/withdrawal slot in the inserter frame 15. Upon detection of the insertion by an unillustrated sensor, the shutter 12 is closed.

The rotary body 13 is next rotated by an unillustrated drive source so that the bill guide 14 undergoes an angular displacement to the feed-in position b. The bills are then fed out at a low speed in a stacked state by an unillustrated roller from the bill guides 14 to the bill separating and counting unit 16.

After the bills have been separated and counted one by one at the bill separating and counting unit 16, they are conveyed to a bill discriminator 17 along a transfer path 21*a*. Bills which have been found "good" as a result of checking by the bill discriminator 17 are conveyed to the first storage portion 18 for storage, while those found "bad" by the bill discriminator 17 are conveyed to the second storage portion 19 for storage. At this time, the bill guide 14 of the receiving/dispensing unit 11 has undergone an angular displacement to the receiving position c so that the bill guide 14 is ready to receive the bills from the first storage portion 18 or from the second storage portion 19.

The bills stored in the second storage portion 19, namely, those having been found "bad" are conveyed together along a transfer path 21*c* and are introduced into the bill guide 14.

The rotary body 13 then rotates so that the bill guide 14 undergoes an angular displacement to the feed-in position b again. The bills are fed out to the bill separating and counting unit 16. They are fed further to the bill discriminator 17, so that they are checked again there.

The bills which have been found "good" as a result of the above checking are stored in the first storage portion 18. On the other hand, those found to be "bad" are stored in the second storage portion 19.

The bills, which have been stored again in the second storage portion 19 as a result of the rechecking as described above, are conveyed along the transfer path 21*c* and are received in the bill guide 14 which has been held in readiness at the receiving position c. The rotary body 13 then rotates so that the bill guide 14 undergoes an angular displacement to the customer position a, where the shutter 12 is opened to return the bad bills to the customer.

After the bad bills have been returned, the shutter 12 is closed and the bill guide 14 returns to the receiving position c.

After the bad bills have been returned to the customer as described above, the amount dispensed is verified by the customer. When the customer presses a verification button in the customer panel, the bills stored in the first storage portion 18, namely, the bills which have been found "good" are conveyed along the transfer path 21*c* and are received in the bill guide 14. These bills are then conveyed along a transfer path 21*d* by way of the bill separating and counting unit 16 and the bill discriminator 17. In the course of being conveyed along the transfer path 21*d*, the bills are sorted according to whether they are normal or marred and also according to value denomination, and are then stored in a bill storage box 20 by an unillustrated storing means.

When a withdrawal transaction is next conducted, the customer presses an unillustrated withdrawal button provided in the customer panel. After insertion of the card 23 into the card insertion slot 22, the customer presses appropriate personal code number buttons and withdrawal amount buttons, causing the machine to communicate with the computer center.

When verified by the communication, the necessary number of bills is dispensed by a paying-out means according to value denomination from the bill storage box 20 and are fed out to a transfer path 21*e*. The bills are fed out from the transfer path 21*e* to the transfer path 21*a* and are then conveyed to the bill discriminator 17. Checking is conducted by the bill discriminator 17. Bills confirmed as "good" by the bill discriminator 17 are conveyed along the transfer path 21*b* and are then stored in the first storage portion When bills to the value indicated by the customer have been stored in the first storage portion 18, a slip of paper with the details of the transaction printed by an unillustrated printer (hereinafter called the "transaction printout") is conveyed to and placed on the bills stored in the first storage portion 18.

The bills and transaction printout, which have been stored in the first storage portion as described above, are conveyed along the transfer path 21*c* and are then received in the bill guide 14 which has been held in readiness at the receiving position c.

The rotary body 13 then rotates so that the bill guide 14 undergoes an angular displacement to the customer position a. The shutter 12 is opened and the bills are thus dispensed to the customer.

If the customer forgets to pick up the bills and transaction printout after the shutter 12 has been opened, the rotary body 13 rotates so that the bill guide 14 undergoes an angular displacement to a feed-in position d and the bills and transaction printout are fed out to and stored in the temporary storage box 24.

As has been described above, the receiving/dispensing unit 11 in the conventional automatic teller machine can handle both deposited and dispensed bills through the same deposit/dispense slot because the bill guide 14 can undergo angular displacements to the four positions a, b, c and d. Further, the bills and transaction printout, which the customer forgets to pick up, can be stored in the temporary storage box 24 as a result of an angular displacement of the bill guide 14 to the feed-in position d.

In the conventional automatic teller machine described above, the receiving/dispensing unit—through which bills are received from or given to a customer—and the separating unit of the bill separating and counting unit—which receives bills from the customer or from the transfer path and separate and feed them one by one to the bill discriminator—are discrete from each other. This has led to the problem that the machine unavoidably becomes complex and large.

In addition, the transfer of bills from the receiving/dispensing unit to the separating unit requires thee bills to be stacked so that there is a high possibility of causing a transfer problem such as jamming during transfer of the bills. This results in a reduction in the reliability of the transfer and, since the transfer of the bills from the receiving/dispensing unit to the separating unit is carried out at a low speed, also in the problem that the processing speed of bills is slow.

Further, the rotary body is rotated by way of a belt. Because of variations in the adjustment of the belt tension, deformations of the belt due to the inertia force of the rotary body produced when the rotary body stops, and other causes, the rotary body cannot be stopped precisely and consistently at the same positions.

When bills are fed into the receiving/dispensing unit or when bills are fed into the bill guide from the first or second storage portion, the point of transfer may be shifted to cause a bill jam, thereby resulting in the problem that the machine is caused to close down.

When a load or resistance such as hooking is applied to bills as a result of such shifting of the point of transfer so that the smooth transfer of the bills is impaired, the bills are immediately skewed. This leads to the problem that the reliability of the conveyance performance of the automatic teller machine is reduced.

SUMMARY OF THE INVENTION

A first object of the present invention is to provide an automatic teller machine equipped with a receiving/dispensing unit which permits simplification and size reduction of the machine, enhances the reliability of conveyance and further improves the processing speed of bills.

A second object of the present invention is to obtain a construction capable of stabilizing the stopping positions of the rotary body and hence preventing shifting of the point of transfer of the receiving/dispensing unit, thereby preventing the automatic teller machine from closing down due to a bill jam and improving the reliability of the conveyance function of the machine.

To achieve the first object, the present invention provides an automatic teller machine with a receiving/dispensing unit in a customer panel of a main body of the machine. The receiving/dispensing unit has a rotary body, which is composed of two flanges supported for rotation in an opposing relationship and two plate-like bill guides fixed in an opposing relationship and extending in a direction perpendicular to the flanges, and an openable shutter arranged to cover the rotary body at a position facing a customer, whereby the rotary body with bills received together therein is rotated and then stopped at a receiving/dispensing position to conduct a deposit/withdrawal procedure. One ends of the bill guides serve as a receiving opening for receiving the bills from the customer panel. The rotary body is provided with a means for separating and feeding the bills one by one and an opening for feeding the thus-separated bills into the main body.

To attain the second object, the present invention also provides an automatic teller machine with a receiving/dispensing unit in a customer panel of a main body of the machine. The receiving/dispensing unit has a rotary body, which is composed of two flanges supported for rotation in an opposing relationship and two plate-like bill guides fixed in an opposing relationship and extending in a direction perpendicular to the flanges, and an openable shutter arranged to cover the rotary body at a position facing a customer, whereby the rotary body with bills received together therein is rotated and then stopped at a receiving/dispensing position to conduct a receiving/dispensing procedure. One ends of the bill guides serve as a receiving opening for receiving the bills from the customer panel. A gear is formed in an outer periphery of at least one of the flanges. The rotary body is provided with a means for separating and feeding the bills one by one and an opening for feeding the thus-separated bills into the main body. A drive source is also provided to rotate the gear.

DESCRIPTION OF THE PREFERRED EMBODIMENT

One embodiment of the present invention will hereinafter be described with reference to the drawings, in which like elements of structure are identified by like symbols.

Figure 9:
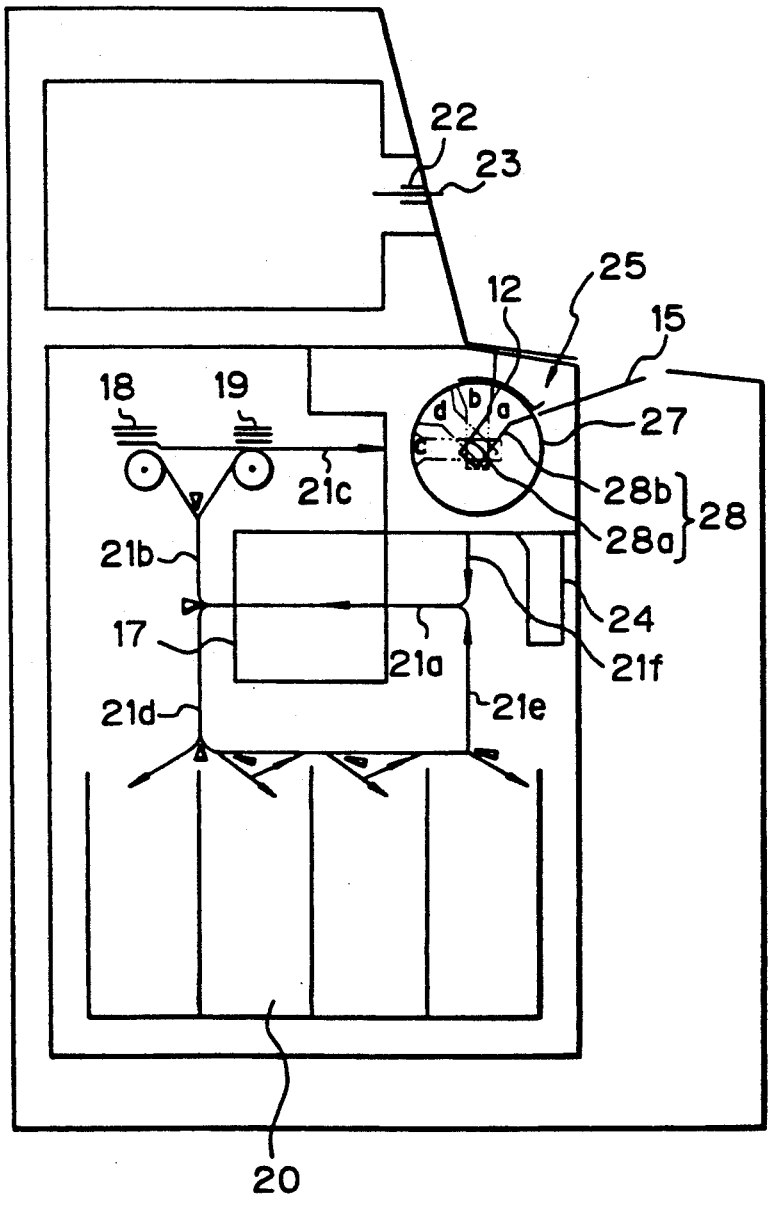
FIG. 9 is a simplified side view illustrating the internal construction of the automatic teller machine.
Figure 10:
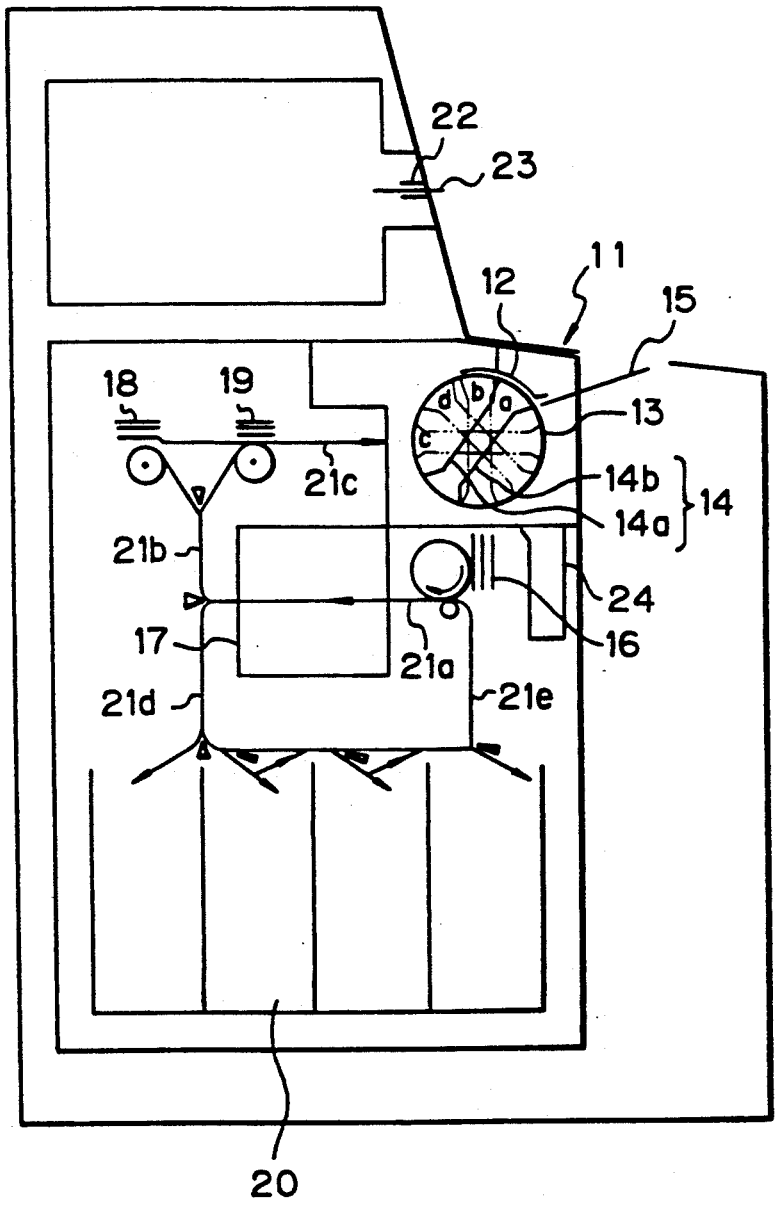
Fig. 10 (PRIOR ART)
FIG. 10 is a simplified side view showing the internal construction of a conventional automatic teller machine.

In FIG. 9, there are shown a bill discriminator 17, a first storage portion 18, a second storage portion 19, a bill storage box 20, transfer paths 21*a*–21*f* constructed of bill conveying means, a card insertion slot 22, a passbook or card 23, and a temporary storage box 24. They are the same elements as the corresponding elements in the conventional automatic teller machine and are thus identified by the same symbols.

A receiving/dispensing unit 25 has the functions of both the conventional receiving/dispensing unit 11 and the separating and counting unit 16. The drawing shows only a shutter 12, a rotary body 27, a bill guide 28 and an inserter frame 15 out of various elements making up the receiving/dispensing unit 25. The rotary body 27 and the transfer path 21*a* are connected by way of a transfer path 21*f*.

Figure 1:
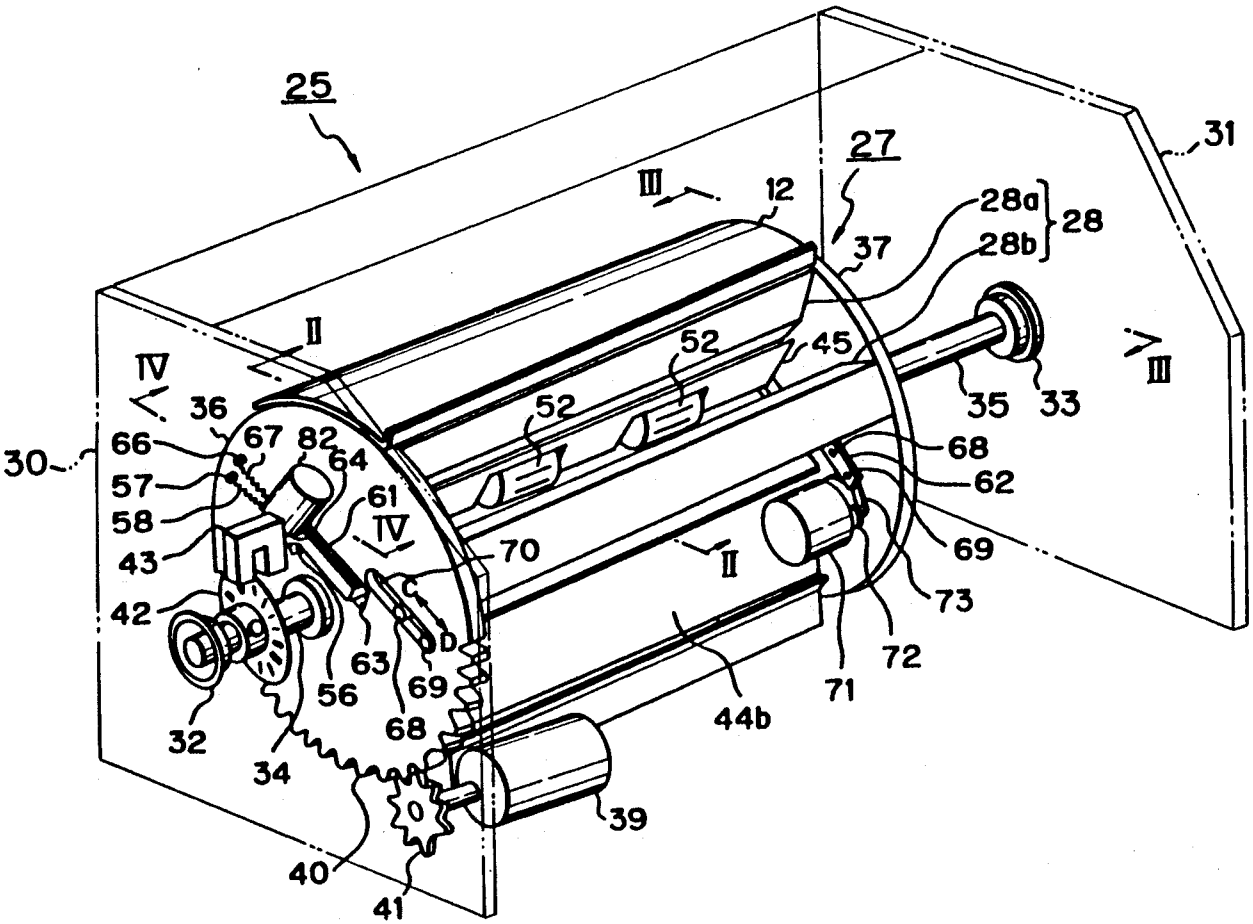
FIG. 1 is a perspective view of a receiving/dispensing unit in an automatic teller machine according to a preferred embodiment of the present invention.

As is illustrated in FIG. 1, the receiving/dispensing unit 25 in the automatic teller machine according to the present invention has a rotary body 27 supported for free rotation on short shafts 34,35 which are in tern supported by bearings 32,33 mounted on side frames 30,31 indicated by two-dot chain lines and arranged in a pair.

A motor 39 as a drive source for the rotary body is a motor for rotating the rotary body 27, and a motor gear 41 is provided on a motor shaft. A flange 36 with a gear 40 formed therein is mounted on the short shaft 34, whereby rotation of the motor 39 can turn the rotary body 27.

A slit disk 42 is also fixed on the short shaft 34 of the flange 36. Reading of the degree of rotation of the slit disk 42 by an encoder 43 makes it possible to detect the angle of rotation of the rotary body 27. To cause the rotary body 27 to rotate to a predetermined position, the motor 39 is controlled while detecting the position of the rotary body 27 by means of the encoder 43.

Figure 2:
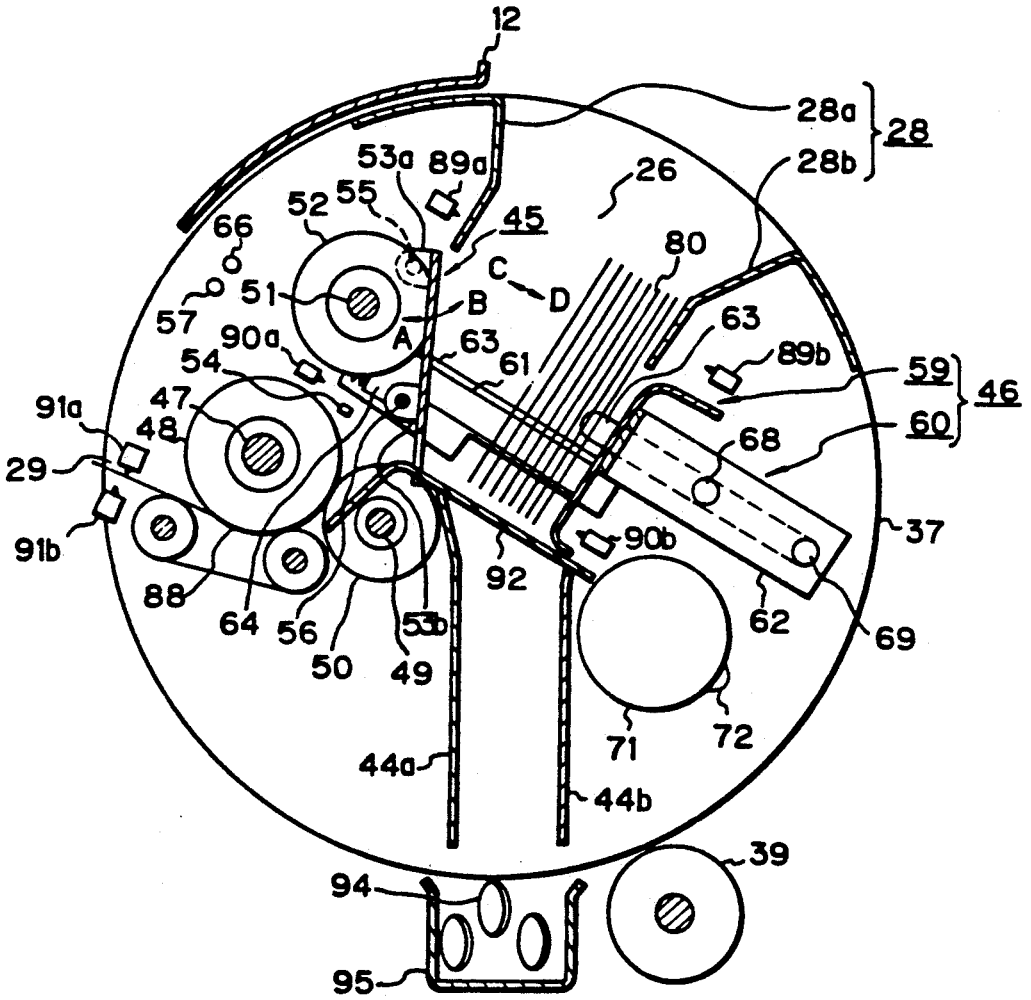
FIG. 2 is a cross-sectional view seen in the direction of arrows II—II of FIG. 1, which illustrates structural details of a rotary body.
Figure 3:
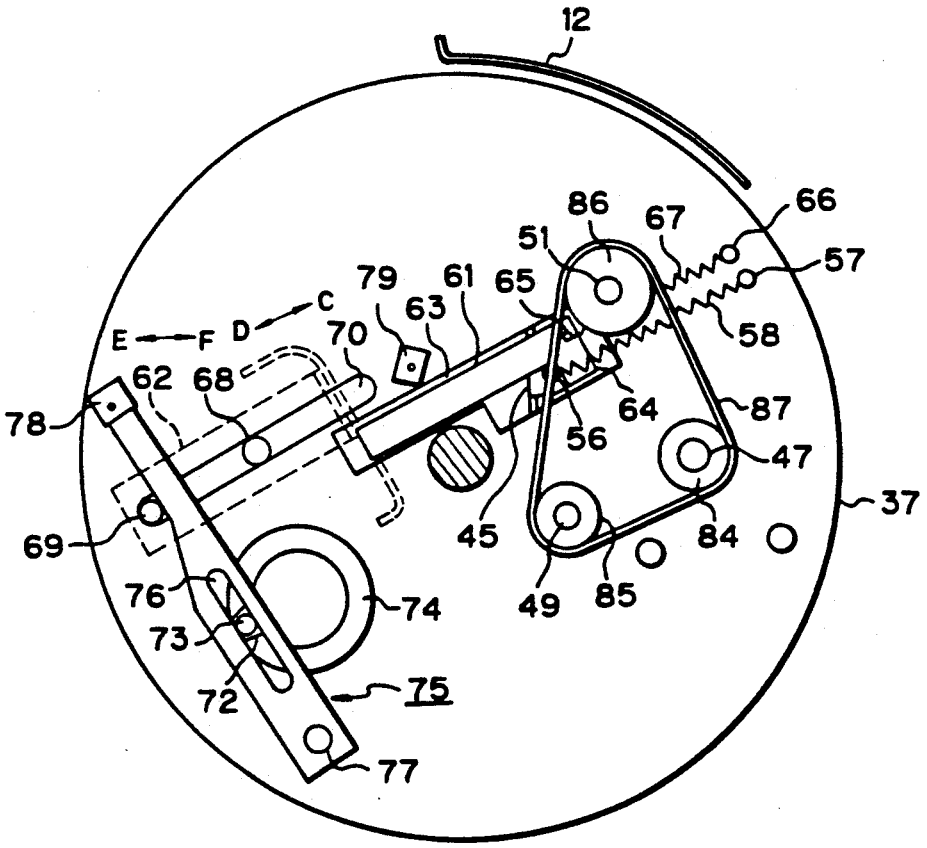
FIG. 3 is a cross-sectional view seen in the direction of arrows III—III of FIG. 1, which also depicts structural details of the rotary body.

The rotary body 27 is provided with two flanges 36,37 fixed in an opposing relationship on the short shafts 34,35, two bill guides 28*a*,28*b* and two coin guides 44*a*,44*b*, both arranged in directions perpendicular to the flanges 36,37 so that they extend between the flange 36 and the flange 37 as shown in FIG. 2, a bill pusher 46 arranged on a side of the bill guide 28*b* movably toward and away relative to a center guide 45, a feed roller 48 fixed on a shaft 47 so that the feed roller 48 is located at an inner end of the bill guide 28*a*, a reverse roller 50 fixed on a shaft 49 so that the reverse roller 50 contacts the feed roller 48, and a picker roller 52 fixed on a shaft 51 so that a part of an outer periphery of the picker roller 52 enters toward the bill pusher 46 through an opening formed in the center guide 45 as depicted in FIG. 1. The center guide 45 has tabs 53*a*,53*b* at opposite ends thereof and, as is shown in FIG. 2, is attached movably in the direction indicated by arrows A,B about a post 55 provided between the flanges 36,37 and the tab 53*a*. A spring post 56 is fixed on the tab 53*b*and, as is illustrated in FIGS. 2 and 3, springs 58 extend between the spring posts 56 and spring posts 57 formed on the flanges 36,37 as shown in FIGS. 2 and 3. The center guide 45 is caused to pivot in the direction of arrow A and is brought into contact with a stopper 54. The bill pusher 46 has been formed by fixing square U-shaped brackets 59,60 by welding or the like so that both arm portions 61,62 extend in opposite directions. The arm portions 61 of the bracket 59 extend out through rectangular slots 63 formed in the flanges 36,37, respectively, and hook portions 64 at free ends of the arm portions 61 are maintained in engagement with the spring posts 56 provided on the center guide 45. The hook portions 64 defines spring holes 65 respectively as illustrated in FIG. 3. As is illustrated in FIGS. 1 and 3, springs 67 extend between the spring holes 65 and corresponding spring posts 66 formed on the flanges 36,37. On the other hand, guide posts 68,69 are provided on each of the arm portions 62 of the bracket 60 as shown in FIGS. 1–3. The guide posts 68,69 are allowed to slide in the direction of arrows C,D along a slot 70 formed in each of the flanges 36,37. In addition, a motor 71 as a drive source for the bill pusher is fixedly secured on the flange 37 as shown in FIGS. 1 and 2. A bracket 72 with a pin 73 fixed thereon is mounted on a motor shaft of the motor 71. As is depicted in FIG. 3, the pin 73 extends out through a circular guide slot 74 formed in the flange 37 and is maintained in engagement with a slot 76 formed in a link 75. The link 75 pivots in the directions of arrows E,F about a post 77 provided on the flange 37. The link 75 is detected by sensors 78,79, whose detection signals control the motor 71.

Here, front end portions of the bill guides 28*a*,28*b* define the receiving opening 26 through which stacked bills 80 can be inserted or taken out. To facilitate the insertion or taking-out of the bills, the opening 26 flares out.

Figure 4:
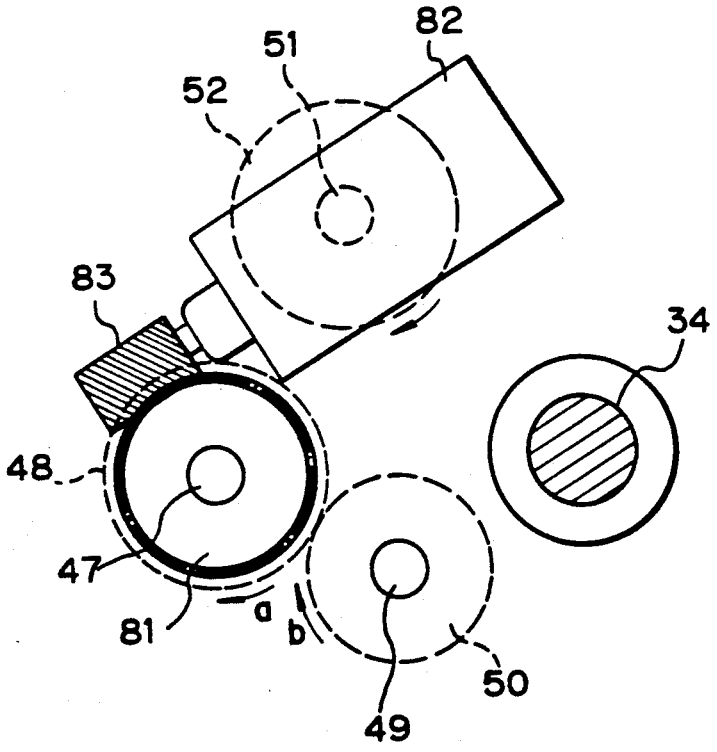
FIG. 4 is a cross-sectional view seen in the direction of arrows IV—IV of FIG. 1, which shows a drive motor and gears in a separating and feeding unit.

The shaft 47 of the feed roller 48, the shaft 49 of the reverse roller 50 and the shaft 51 of the picker roller 52 are all supported for rotation at opposite ends thereof on the flanges 36,37. As is shown in FIG. 4, a gear 81 is provided on one end of the shaft 47 of the feed roller 48. The gear 81 is maintained in meshing engagement with a screw gear 83 of a motor 82 provided as a drive source for the rollers on an outer wall of the flange 36.

As is illustrated in FIG. 3, pulleys 84,85,86 are provided on the other ends of the shafts 47,49,51 of the feed, reverse and picker roller 48,50,52, respectively. A belt 87 is fitted on the individual pulleys 84–86.

Drive force of the motor 82 is therefore transmitted to the shaft 47 via the screw gear 83 and the gear 81 and further from the shaft 47 to the shafts 49,51 by way of the pulley 84, the belt 87 and the pulleys 85,86, whereby the feed roller 48, reverse roller 50 and picker rollers 52 are rotated, respectively.

In this case, the individual rollers 48,50,52 all rotate clockwise as shown in FIG. 4. As is indicated by arrow b, the direction of rotation of the reverse roller 50 kept in contact with the feed roller 48 is however opposite to the direction of rotation of the feed roller 48, said direction being indicated by arrow a at the point of contact between both the rollers.

As a consequence, when the feed roller 48, reverse roller 50 and picker roller 52 rotate in the state that the bills 80 are pushed against the picker roller 52 by means of the bill pusher 46, the first bill 80 which is in contact with the picker roller 52 is fed to the point of contact between the feed roller 48 and the reverse roller 50 and is fed further by further rotation of the feed roller 48, so that the bill 80 is fed in from the rotary body 27. If the second bill 80 is in close contact with the first bill 80 at this time, the second bill 80 sticking close to the first bill 80 is separated by the reverse roller 50 which rotates in the opposite direction to the feed roller 48. The bills 80 can therefore be separated and fed in one by one.

Figure 5:
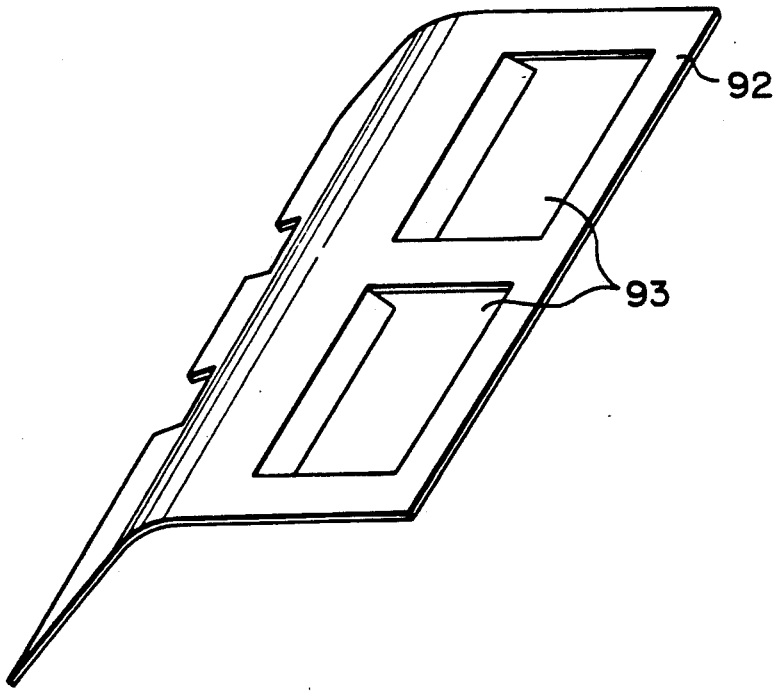
FIG. 5 is a perspective view of an under guide.

Each separated bill 80 is conveyed along a transfer path 88 through a feed-in opening into the machine. Between the bill guides 28*a* and 28*b*, between the center guide 45 and the bill pusher 46 and in the transfer path 88, sensors 89,90,91 are provided respectively, so that the presence or absence of the bill 80 is detected. These sensors are composed of light emitting devices 89*a*, 90*a*,91*a* and photodetectors 89*b*,90*b*,91*b*, respectively. On the top of the coin guides 44*a*,44*b*, an under guide 92 as shown in FIG. 5 is provided. Through openings 93, coils 94 and other foreign objects held between the bills 80 are caused to drop into a catch tray 95.

Figure 6:
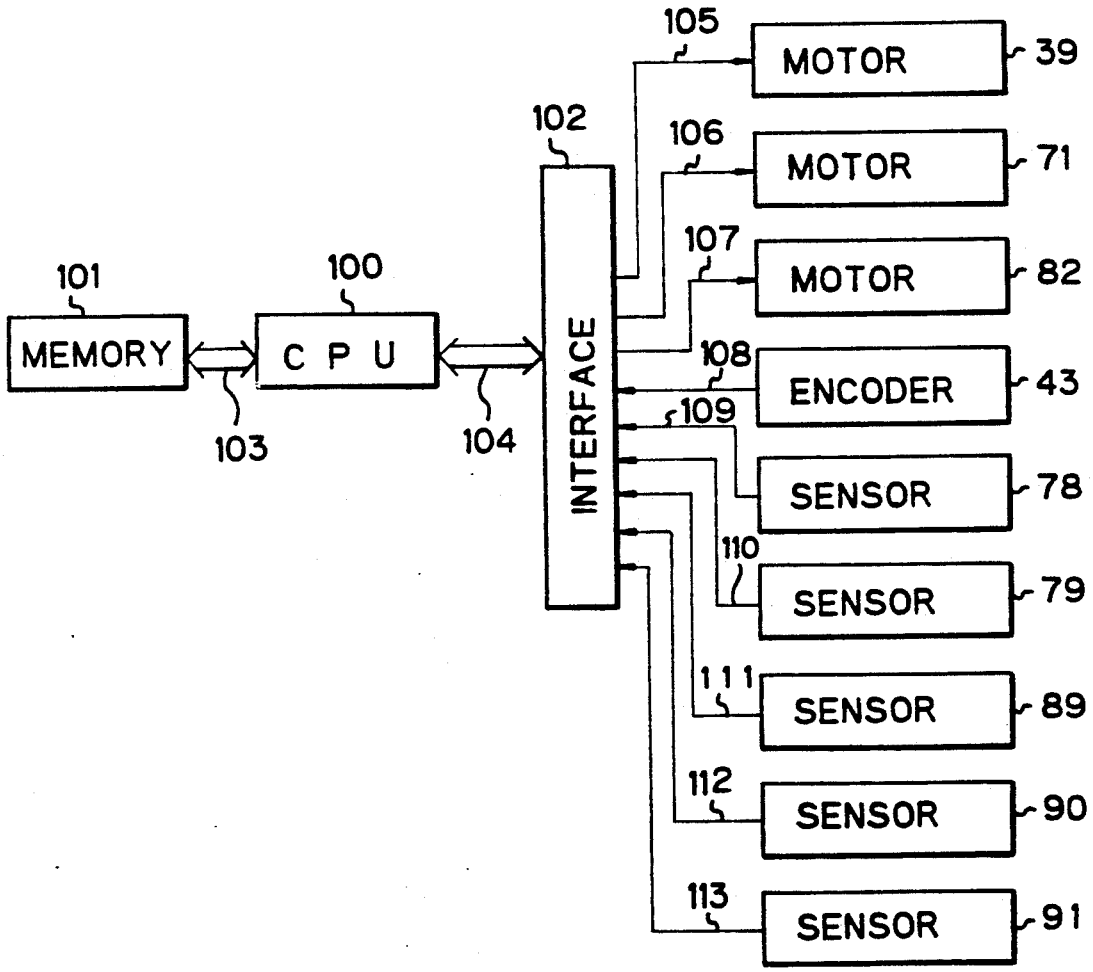
FIG. 6 is a simplified block diagram showing a control unit in the present invention.

Reference is next had to FIG. 6. To a central processing unit 100 (hereinafter referred to as "CPU 100"), a main storage device 101 (hereinafter referred to as "memory 101") and an interface 102 are connected via bus lines 103,104, respectively. The motors 39,71, 82, encoder 43 and sensors 78,79,89,90,91 are connected to the interface 102 via lines 105–113, respectively. A control program, position data for the rotary body 27, etc. are stored in the memory 101.

Figure 7:
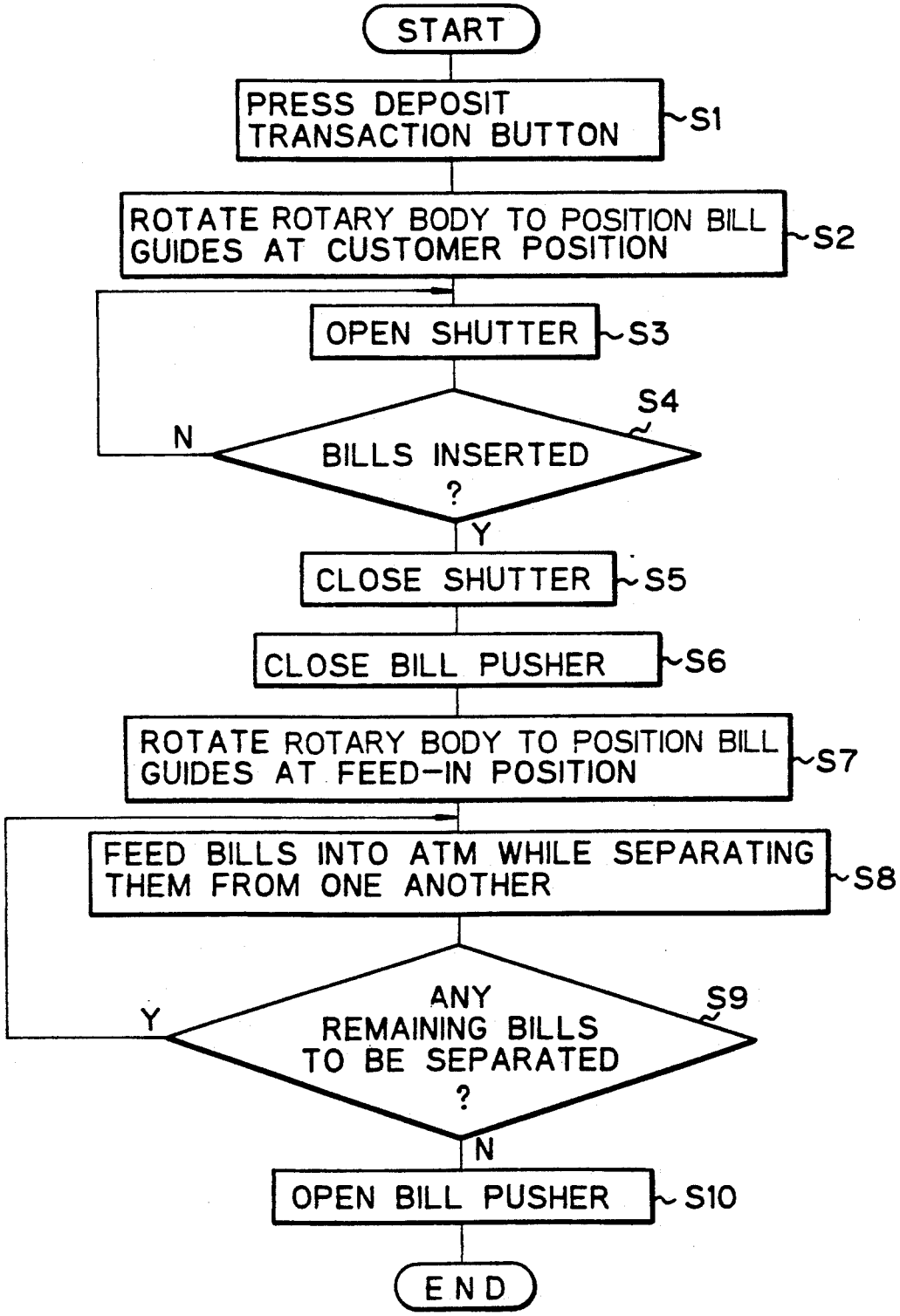
FIG. 7 is a flow chart illustrating a deposit transaction by means of the automatic teller machine equipped according to the one embodiment of the present invention, which is equipped with the receiving/dispensing unit shown in FIGS. 1 and 2
Figure 8A:
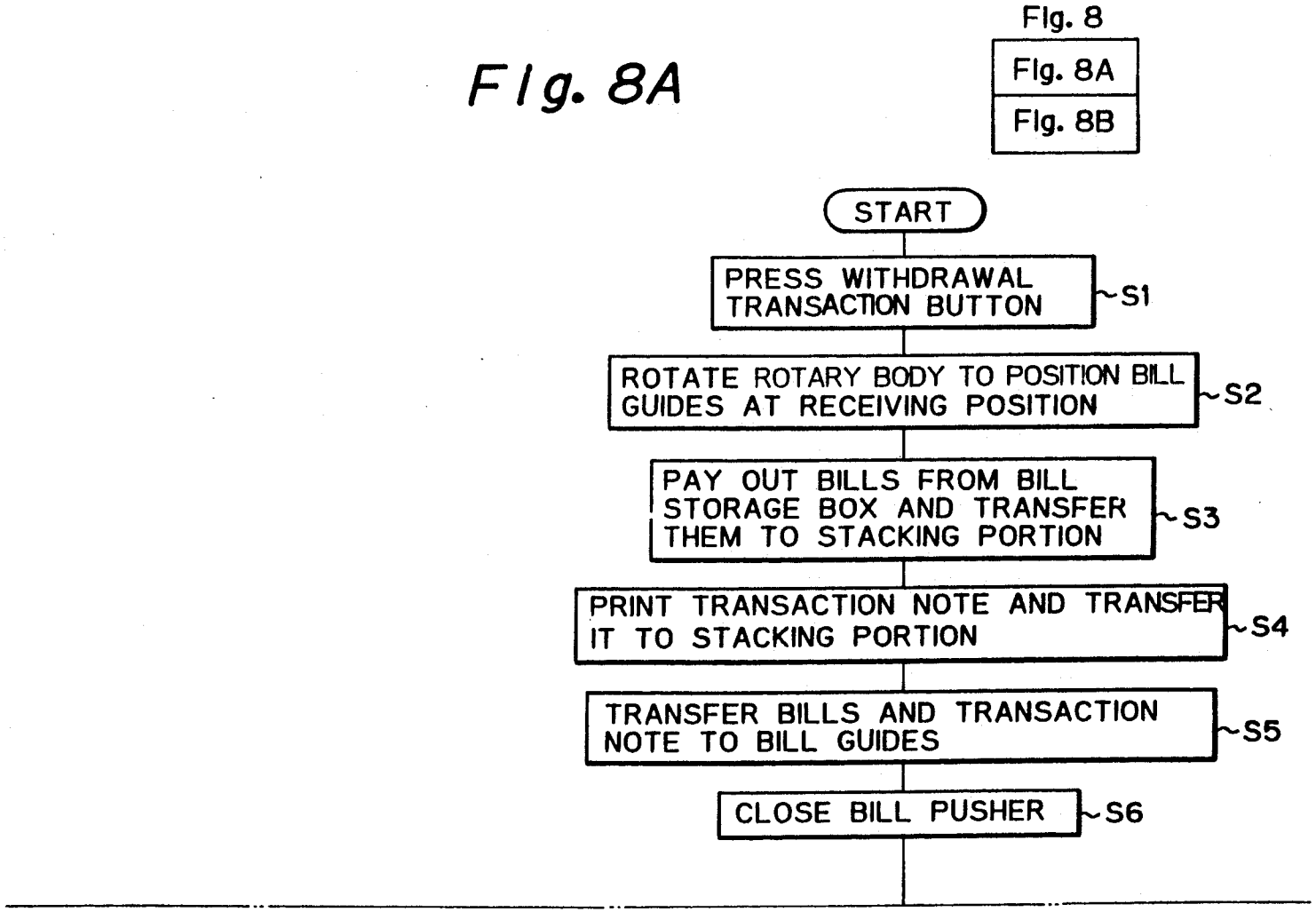
FIG. 8 consisting of FIGS. 8A and 8B is a flow chart showing a withdrawal transaction by means of the automatic teller machine.
Figure 8B:
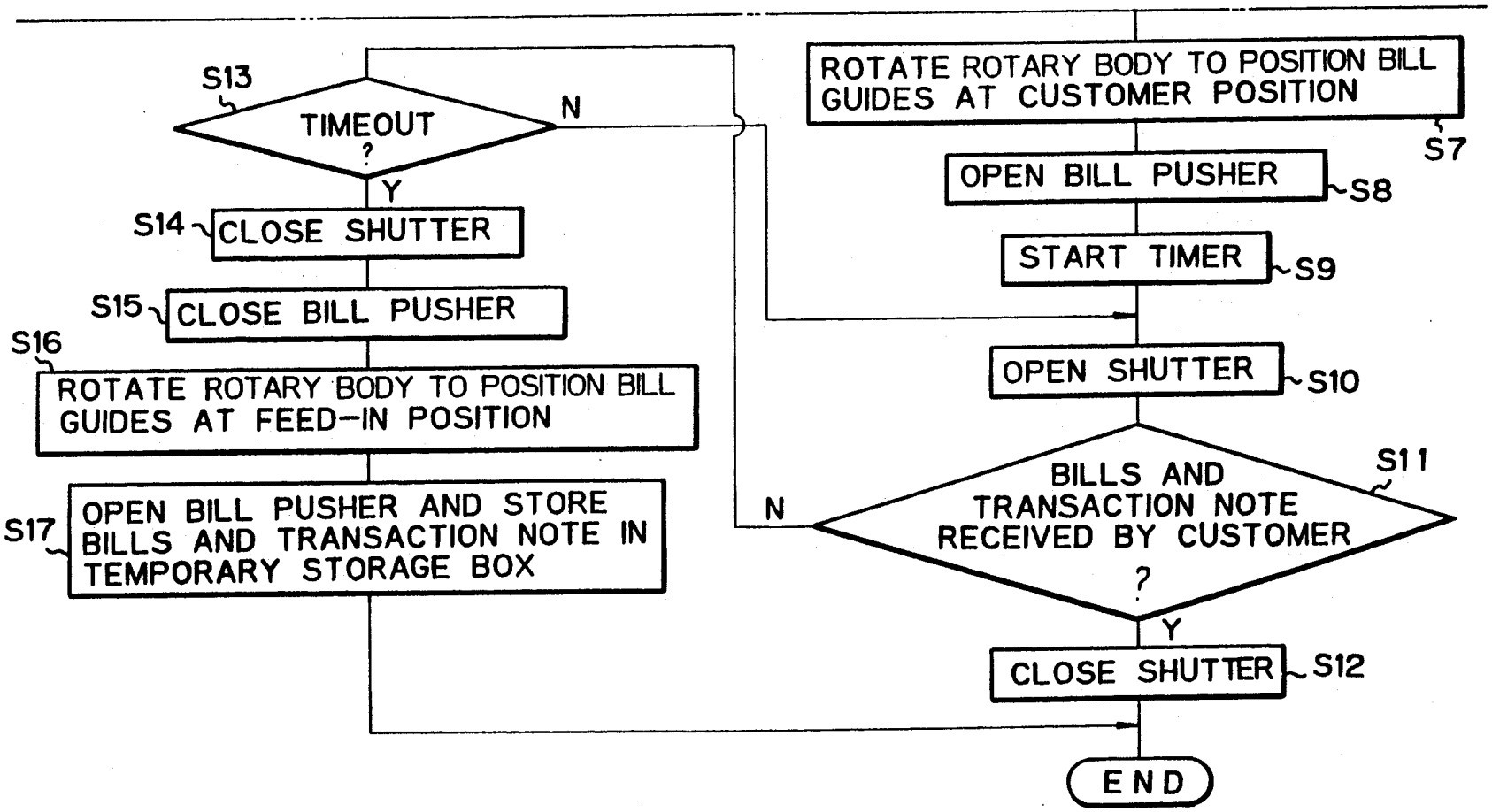

Operation of the automatic teller machine according to the present invention will next be described with reference to FIGS. 7 and 8.

Firstly, a deposit transaction will be described with reference to FIG. 7. In step $S_1$, a customer presses an unillustrated deposit transaction button provided in a customer panel of the machine. When the card 23 is inserted into the card insertion slot 22 as shown in FIG. 9, communication with a computer center is carried out. When verified, CPU 100 actuates the motor 39 in step $S_2$ so that the rotary body 27 is rotated via the gear 41 and flange 36. CPU 100 then reads the degree of rotation of the rotary body 27 by means of the encoder 43 and compares it with the position data stored in the memory 101. When the receiving opening 26 of the bill guide 28 moves to the customer position a, the motor 39 is stopped so that the rotary body 27 is held in readiness. At this time, CPU 100 detects via the sensor 78 that the bill pusher 46 is fully open. In step $S_3$, CPU 100 actuates an unillustrated motor to open the shutter 12.

When the customer inserts the bills 80 together in step $S_4$, CPU 100 detects the insertion of the bills 80 via the sensors 89,90. If the coins 94 and other foreign objects are contained between the bills 80 at this time, they are caused to drop into the catch tray 95 through the openings 93 of the under guide 92. When CPU 100 detects the insertion of the bills 8 via the sensors 89,90, CPU 100 closes the shutter 12 in step $S_5$. CPU 100 then actuates the motor 71 in step $S_6$, whereby the link 75 is caused to pivot in the direction of arrow F as shown in FIG. 3. This pivotal movement of the link 75 in the direction of arrow F allows the bill pusher 46 to move in the direction of arrow C under the pulling force of the spring 67. As the bill pusher 46 moves in the direction of arrow C, the center guide 45 is caused to pivot in the direction of arrow A by the spring 58 as shown in FIG. 2. When the center guide 45 is brought into contact with the stopper 54 and extends in parallel with the bill pusher 46, the bills 80 are brought into the state that they are held between the picker roller 52 and the bill pusher 46. During this period, CPU 100 is ready to detect the link 75 via the sensor 79. As soon as the link 75 is detected, CPU 100 stops the actuation of the motor 71 (this state will hereinafter be referred to as the "closure of the bill pusher 46").

In step $S_7$, CPU 100 actuates the motor 39 to rotate the rotary body 27, whereby the receiving opening 26 of the bill guide 28 is positioned at the feeding position b. The routine then advances to step $S_8$, where CPU 100 actuates the motor 82 so that the feed roller 48, reverse roller 50 and picker roller 52 are rotated to separate the bills 80 one by one. The bills 80 are then fed to the transfer path 21*f* so that the bills 80 are conveyed into the machine along the transfer path 88. During this period, CPU 100 monitors the number of the bills 80 and the intervals between the successive bills by means of the sensor 91. Whenever the bill 80 is fed in, CPU 100 detects the presence or absence of the bills 80 between the center guide 45 and the bill pusher 46 via the sensors 89,90 in step $S_9$. Upon detection of the absence of the bills 80, the actuation of the motor 82 is stopped. In step $S_{10}$, CPU 100 actuates the motor 71 to move the bill pusher 46 in the direction of arrow D as shown in FIG. 2. As he bill pusher 46 moves in the direction of arrow D, the center guide 45 is caused to pivot in the direction of arrow B. Upon detection of the link 75 by the sensor 78, the actuation of the motor 71 is stopped (this state will hereinafter be referred to as "opening of the bill pusher 46"). In this state, the machine is now ready to accept the next transaction.

The handling of the bills 80 conveyed into the machine and the operation of the rotary body 27 are as already described above in connection with the conventional art.

A withdrawal transaction will next be described with reference to FIG. 8. In step $S_1$, a customer presses an unillustrated withdrawal transaction button provided in the customer panel of the machine. When the card 23 is inserted into the insertion slot 22 as shown in FIG. 9 and appropriate personal code number buttons and withdrawal amount buttons are then pressed, communication with a computer center is carried out. When verified through the communication, CPU 100 actuates the motor 39 in step $S_2$ so that the rotary body 27 is rotated to position the receiving opening 26 of the bill guide 28 at the receiving position c. In step $S_3$, by an unillustrated paying-out means, CPU 100 dispenses the desired number of bills according to value denomination from the bill storage box 20 and feeds them out to the transfer path 21*e*. The bills are conveyed from the transfer path 21*e* to the bill discriminator 17 via the transfer path 21*a*. The bills are checked by the bill discriminator 17. Those found to be "good" by the bill discriminator 17 are conveyed along the transfer path 21*b*, whereby they are stored in the first storage portion 18.

When bills to the value indicated by the customer have been stored in the first storage portion 18, CPU 100 causes an unillustrated printer to print the details of the transaction in step $S_4$ so that a transaction printout is conveyed to and placed on the bills stored in the first storage portion 18.

In step $S_5$, CPU 100 conveys along the transfer path 21*c* the bills and transaction printout which have been stored in the first storage portion 18. They are received in the bill guide 28 held in readiness at the receiving position c.

The routine then advances to step $S_6$, where CPU 100 actuates the motor 71 to close the bill pusher 46. As a result, the bills and transaction printout are held between the bill pusher 46 and the picker roller 52. In step $S_7$, CPU 100 actuates the motor 39 to rotate the rotary body 27 so that the receiving opening 26 of the bill guide 28 is positioned at the customer position a. In step S8, CPU 100 actuates the motor 71 to open the bill pusher 46, whereby the bills and transaction printout are released. In Step $S_9$, CPU 100 causes an unillustrated timer of CPU to start. In step $S_9$, CPU 100 actuates an unillustrated motor to open the shutter 12. In step $S_{11}$, when the customer receives the bills and transaction printout, CPU 100 closes the shutter 12 and the machine is now ready for the next transaction.

When the customer forgets to pick up the bills and transaction printout in step $S_{11}$ subsequent to opening of the shutter 26 in step $S_{10}$, CPU 100 detects a timeout in step $S_{13}$ so that the shutter 12 is closed in step $S_{14}$. CPU 100 then actuates the motor 71 in step $S_{15}$, whereby the bill pusher 46 is closed. In step $S_{16}$, CPU 100 actuates the motor 39 to rotate the rotary body 27 so that the receiving opening 26 of the bill guide 28 is positioned at the feed-in position d. In step $S_{17}$, the motor 71 is actuated to open the bill pusher 46, whereby the bills and transaction printout are stored in the temporary storage box 24. The machine is now ready for the next transaction.

What is claimed is:

1. In an automatic teller machine with a receiving/-dispensing unit in a customer panel of a main body of the machine, said receiving/dispensing unit having a rotary body, which is composed of two flanges supported for rotation in an opposing relationship and two plate-like bill guides fixed in an opposing relationship and extending in a direction perpendicular to the flanges, and an openable shutter arranged to cover the rotary body at a position facing a customer, whereby the rotary body with bills received together therein is rotated and then stopped at a receiving/dispensing position to conduct a receiving/dispensing procedure, the improvement wherein one ends of the bill guides serve as a receiving opening for receiving the bills from the customer panel, and the rotary body is provided with a means for separating and feeding the bills one by one and an opening for feeding the thus-separated bills into the main body.

2. The machine of claim 1, wherein the separating and feeding means comprises:

a bill pusher provided on a side of one of the bill guides so that the bill pusher is movable toward and away relative to the other bill guide;

a bill pusher drive source for moving the bill pusher;

a picker roller arranged so that a part of an outer periphery of the picker roller can enter between the bill guides from a side of the other bill guide to hold bills, which have been inserted or fed between the bill guides and are to be pushed by the bill pusher, between the picker roller and the bill pusher and to feed the bills toward rear end portions of the bill guides;

a feed roller arranged at the rear end portions of the bill guides to feed bills, which have been fed from the picker roller, to a feed-in opening for a bill discriminator unit;

a reverse roller arranged in contact with the feed roller to separate one by one the bills to be fed into the feed-in opening; and a roller drive source for rotating the picker roller, feed roller and reverse roller.

3. In an automatic teller machine with a receiving/-dispensing unit in a customer panel of a main body of the machine, said receiving/dispensing unit having a rotary body, which is composed of two flanges supported for rotation in an opposing relationship and two platelike bill guides fixed in an opposing relationship and extending in a direction perpendicular to the flanges, and an openable shutter arranged to cover the rotary body at a position facing a customer, whereby the rotary body with bills received together therein is rotated and then stopped at a receiving/dispensing position to conduct a deposit/withdrawal procedure, the improvement wherein one ends of the bill guides serve as a receiving opening for receiving the bills from the customer panel, a gear is formed in an outer periphery of at least one of the flanges, the rotary body is provided with a means for separating and feeding the bills one by one and an opening for feeding the thus-separated bills into the main body, and a drive source is provided to rotate the gear.

4. The machine of claim 3, wherein the separating and feeding means comprises:

a bill pusher provided on a side of one of the bill guides so that the bill pusher is movable toward and away relative to the other bill guide;

a bill pusher drive source for moving the bill pusher;

a picker roller arranged so that a part of an outer periphery of the picker roller can enter between the bill guides from a side of the other bill guide to hold bills, which have been inserted or fed between the bill guides and are to be pushed by the bill pusher, between the picker roller and the bill pusher and to feed the bills toward rear end portions of the bill guides;

a feed roller arranged at the rear end portions of the bill guides to feed bills, which have been fed from the picker roller, to a feed-in opening for a bill discriminator unit;

a reverse roller arranged in contact with the feed roller to separate one by one the bills to be fed into the feed-in opening; and a roller drive source for rotating the picker roller, feed roller and reverse roller.

* * * * *